United States Patent [19]

Ferris et al.

[11] Patent Number: 4,497,261

[45] Date of Patent: Feb. 5, 1985

[54] SECURITY ENCLOSURE FOR AN AUTOMATIC TELLER MACHINE

[75] Inventors: Richard A. Ferris, Rockville, Md.; Roger M. Hess, Mount Airy, N.C.; James R. Garman, Thurmont, Md.

[73] Assignee: Commercial Modular Systems, Inc., Frederick, Md.

[21] Appl. No.: 508,255

[22] Filed: Jun. 27, 1983

[51] Int. Cl.[3] ..... G07F 5/00

[52] U.S. Cl. ..... 109/2; 109/24.1; 109/66

[58] Field of Search ..... 109/2, 10, 24.1, 71, 109/8, 58, 66, 53, 5, 11, 7, 14; 49/42; 52/29, 31, 65; 221/119; D99/28; D25/16

[56] References Cited

U.S. PATENT DOCUMENTS

| | | | |
|---|---|---|---|
| 1,136,325 | 4/1915 | Everett | 109/9 |
| 1,992,036 | 2/1935 | Reger | 109/9 |
| 2,081,271 | 5/1937 | Ellithorpe | 109/9 |
| 3,237,933 | 3/1966 | Grosswiller, Jr. et al. | 109/10 |
| 4,121,523 | 10/1978 | Hastings | 109/2 |
| 4,179,723 | 12/1979 | Spencer | 361/384 |
| 4,399,755 | 8/1983 | Wiedmann | 109/2 |
| 4,417,527 | 11/1983 | Williams et al. | 109/2 |

FOREIGN PATENT DOCUMENTS

| | | | |
|---|---|---|---|
| 2503234 | 8/1982 | France | 109/2 |

*Primary Examiner*—Gene Mancene
*Assistant Examiner*—James R. Hakomaki
*Attorney, Agent, or Firm*—Eugene F. Osborne, Sr.

[57] ABSTRACT

A structural unit comprises a rectangular base and floor with vertical walls attached to form an enclosure, and with a roof assembled thereto to form a miniature building, for containing a banking transactional computer, designated an automatic teller machine (ATM), which allows customers to withdraw currency and make deposits. The enclosure is designed for installation on narrow drive-through traffic islands and pedestrian walkways and may be used in shopping malls and retail outlets. The enclosure has interior space for private and secure servicing and maintenance of the ATM by bank and computer maintenance personnel. Through the use of an indexing turntable mechanism the ATM may be moved and rotated within the enclosure in order to present the operating portions and electronics of the machine for access required by the bank and computer personnel, without exposing them to conditions which encourage interference by outside agents or bystanders. Service and maintenance of the ATM is accomplished without disrupting traffic outside the enclosure.

8 Claims, 14 Drawing Figures

SECURITY ENCLOSURE FOR AN AUTOMATIC TELLER MACHINE

BACKGROUND OF THE INVENTION

1. Field of the Invention

This invention relates to financial industries having unattended automated terminals for remote customer transactions in withdrawal and depositing of money. More specifically, this invention relates to enclosures or special buildings for the housing of automated teller machines comprising electronic computer systems.

2. Description of the Prior Art

With advances in electronics and computer technologies, the banking institutions have had available in recent years automated teller machines (hereafter ATM) that may be placed in unattended terminals at remote locations where high traffic in walk-up or drive-in clients and customers is likely to exist. To support these remote banking activities a new type of enclosure or building has been introduced into the market place to house the very specialized ATM apparatus.

ATM machines are essentially large steel safes, computer controlled to record transaction, dispense money and accept deposits as through a night depository. Typical ATM are self-contained in a cabinet and weigh from 1,000 lbs. to 3,600 lbs., depending on the model and manufacturer. They stand approximately 6 feet tall by 28 inches wide and 30 to 36 inches in depth with a safe door that opens from the rear side of the ATM. In order for a servicing bank teller to replace money or collect deposits the rear door must be opened for the interior components of the ATM to index out of its cabinet on roller tracks. People doing bank servicing or people doing repair or maintenance work on the machine itself require additional space on either side of the ATM to gain access to its computer and electronic components.

Typical enclosures for ATM applications have been designed such that a minimum depth of 5½ feet is allowed to the rear of the ATM as required space for servicing the apparatus. But, since many banks have existing drive-up traffic lanes where the islands are 3½ to 4 feet in width, the ordinary enclosures for ATMs cannot be installed without major foundation modifications and changes in traffic flow.

The Kiosk Unit of U.S. Pat. No. 4,179,723 is directed to walk-up drive-in applications, however, servicing of the ATM by bank personnel or by computer maintenance crews must be done from the exterior of the housing. Thus the electronic components are exposed to the uncontrolled ambient environment and the service personnel work in the open where they are exposed to all environmental and safety hazards with risks as potential victims of criminal activity.

The security booth of U.s. Pat. No. 4,121,523 is designed to improve security and enable a degree of environmental control, however, it is useful only for walk-in applications. Due to its cylindrical configuration, it occupies far more space than is usually available at drive-through islands or along narrow pedestrian walkways. This security booth has an outer enclosure into which customers gain access and a secondary inner enclosure for housing an ATM, or the like. Within the secondary enclosure a turntable supports the data processing and money transfer apparatus. The turntable and the enclosure doors are independently rotatable to enable selective access and permit involuntary retention of persons be they service personnel, customers, or criminals.

SUMMARY OF THE INVENTION

The present invention pertains to a remote banking or currency dispensing unit and depository which is automated and self-contained in a portable building or enclosure that requires a minimum 4 by 8 foot space for installation. Thus the unit may be located on existing drive-up islands, curbs, walkways, or other places where space is limited. Installed within the building or enclosure is an ATM having a control and currency transfer panel which projects through the front 8 foot wall surface when it is in its normal operating mode. A flange around the face of the ATM fits into a bezel (or flange mounting) which is an integral part of the wall construction. Customers have access to the ATM by walking-up or by drive-in. Access by bank personnel or ATM service workers to the building is through a walk-in door located, typically, in the 4 foot left-side wall. The door entrances directly into a work area.

Apparatus is integrated in the building structure by which a bank or service operator may gain entry into the ATM cabinet to replenish its stock of currency, collect deposits, or service the electronics. The ATM is supported and is mounted to a laterally movable carriages and turntable. The assembly is movable laterally by an electric motor drive and is rotatable manually as a turntable. The bank or service operator activates the motor drive to move the ATM away from the bezel, back into the building a distance that is sufficient for the flange of the ATM to clear the bezel during rotation. Then the ATM and turntable are rotated counter-clockwise through approximately 90 degrees so as to locate the rear of the ATM cabinet facing the building work area. A steel sliding door is provided to close the opening in the front wall of the building during the withdrawal of the ATM for its maintenance. The steel door is moved in place manually and is locked in place to secure the work area and preserve the environmental conditions. Thus the ATM cabinet may be opened for maintenance as required in the secured area without interruption or interference in any way with traffic or other activity external to the enclosure. The described operation is reversed to return the ATM to operational service to customers.

An object of the present invention is to provide a private and secure working space is the interior of the ATM enclosure that is accessible only by authorized bank servicing and computer maintenance personnel.

Another objective of the present invention is to provide an ATM enclosure, having a secure interior working area for servicing the machine, in a dimensional configuration suitable for installation on narrow drive-through "islands", along narrow pedestrian walkways, or in retail outlets and shopping malls.

Another objective of the present invention is to preserve the integrity of the ATM environment while the unit is out of customer service for maintenance.

A further objective of the present invention is to provide apparatus for service personnel to secure the ATM under emergency conditions when public sources of electrical power to the enclosure become inoperative.

BRIEF DESCRIPTION OF THE DRAWINGS

Other objects and advantages may be observed from the description when viewed in conjunction with the accompanying drawings wherein.

DETAILED DESCRIPTION OF THE INVENTION

Figure 1:
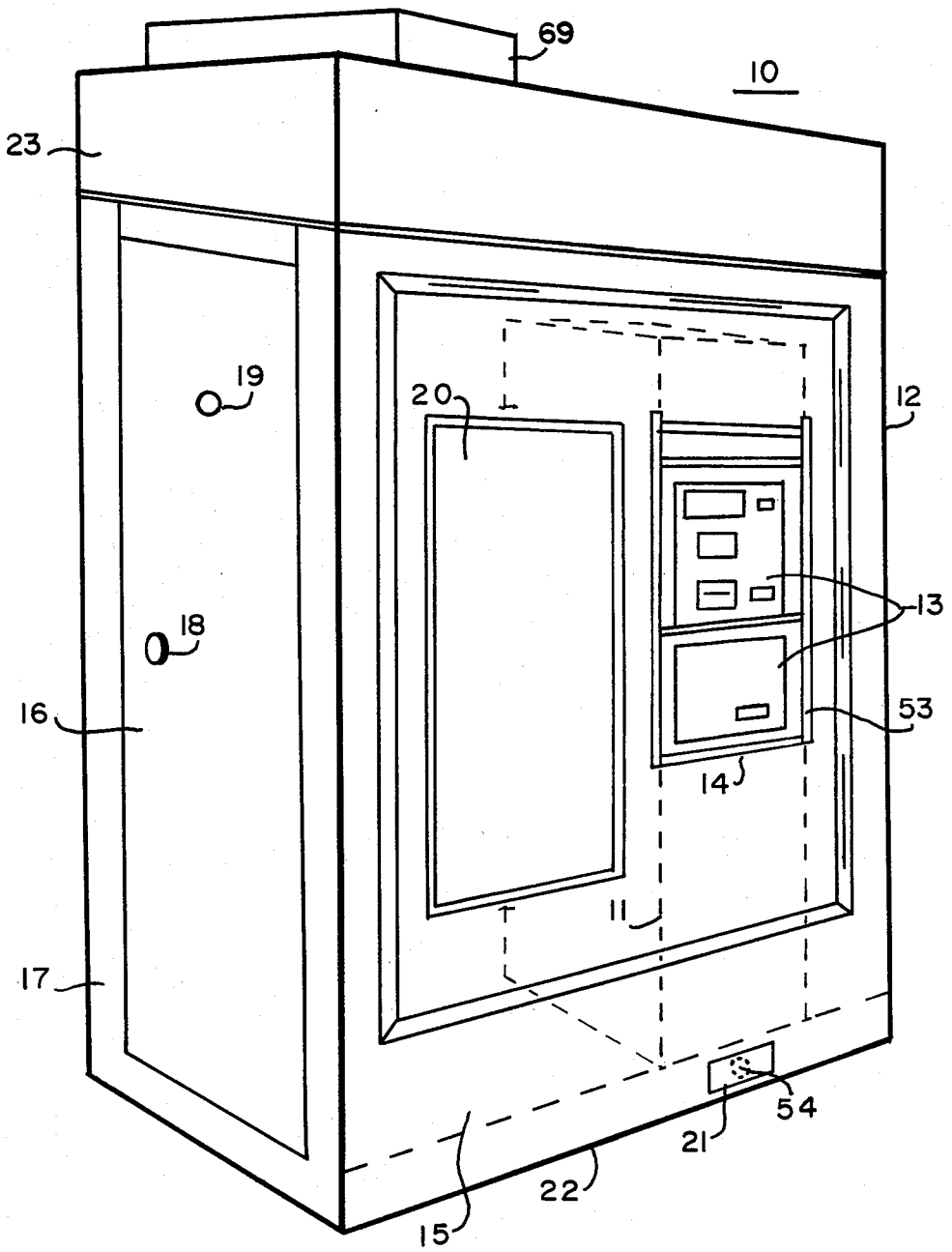
FIG. 1 is a perspective view of the new and improved enclosure comprising the present invention.

Referring now to the drawings, the invention pertains to an unattended self-contained terminal 10 at which customers may walk or drive up to conduct remote automated banking transactions or other similar transactions that are possible with electronic computer and data processing systems. Shown in FIG. 1 is the terminal 10 which comprises an automatic teller machine (ATM) 11, housed in an enclosure 12 which is constructed of vertical planar walls in the nature of a security vault and which occupies a floor space of a minimum of four by eight feet. The control panel and transfer devices 13 of the ATM are exposed to the exterior of the enclosure 12, being projected through an opening 14 in the front eight foot wall 15. A secured door 16 in the left four foot end wall 17 permits entry into the vault or interior of the enclosure 12 to bank service personnel or to ATM maintenance crews. In addition to a means 18 for locking the door 16 a viewing port 19 allows persons inside the enclosure 12 to view the exterior area adjacent to the door 16. A panel 20 is for display of instructions and/or advertising matter on the front wall 15. Cover plate 21 closes an access port to a base subassembly hereafter described. The enclosure 12 has an integral floor 22 and a roof assembly 23 which may be detacted by means provided in the interior of the enclosure 12. Heating and air conditioning systems 69 are incorporated in the roof assembly 23, FIG. 1. The entire terminal is factory assembled for subsequent transportation by heavy equipment to the installation sites.

Figure 2:
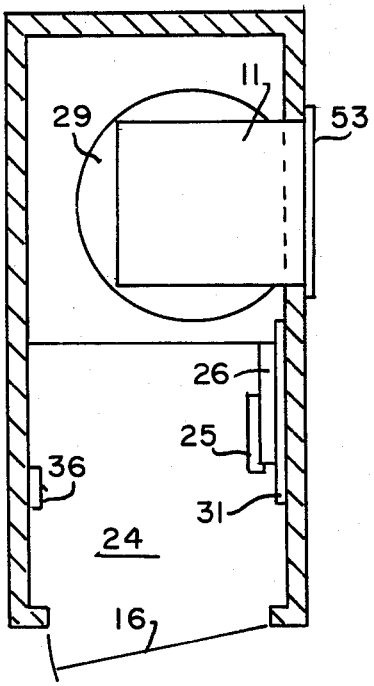
FIG. 2 is a floor plan of the improved enclosure showing the ATM customer use configuration.
Figure 3:
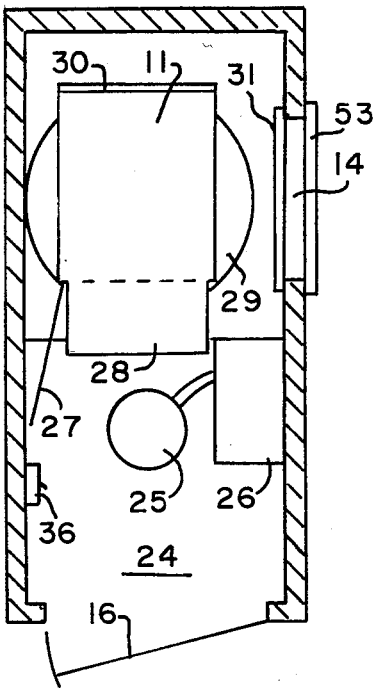
FIG. 3 is a floor plan showing the ATM in position for servicing by bank or computer maintenance personnel.

FIGS. 2 and 3 illustrate the floor plan of the enclosure 12 in the operational and servicing (or maintenance) configurations respectively. The entry door 16 opens into a work area 24 which is provided with a swing-away stool 25 and a fold-away table 26, both for the use and convenience of service personnel. In the operational configuration for servicing customers on the outside of the enclosure 12 its inside space limitations prevent the opening of ATM cabinet doors 27 and the equipment drawers 28. It is therefore necessary to reposition the ATM 11 for servicing. The ATM 11 is supported by a base subassembly comprising a movable carriage and a rotatable turntable 29 which allows a rearward translational motion so that the flange 30 of the ATM 11 may clear the wall opening 14 after which counterclockwise rotary motion of ninety degrees permits opening of cabinet doors 27 and equipment drawers 28 into the enclosure work area 24. Translational motion is powered by an electric motor drive system. With the ATM 11 in the servicing position, a sliding steel plate 31 is manually moved to close the front wall opening 14 to secure the enclosure 12 and preserve the internal ambient environment as regulated by the heating and air conditioning system 69. When the ATM 11 is in the servicing position bank personnel can perform their functions, such as restocking the currency elevator, collecting customer deposits and information from the ATM computer. Computer maintenance crews have access to the equipment drawers for testing, adjustment, or repair of the electronic apparatus.

Figure 14:
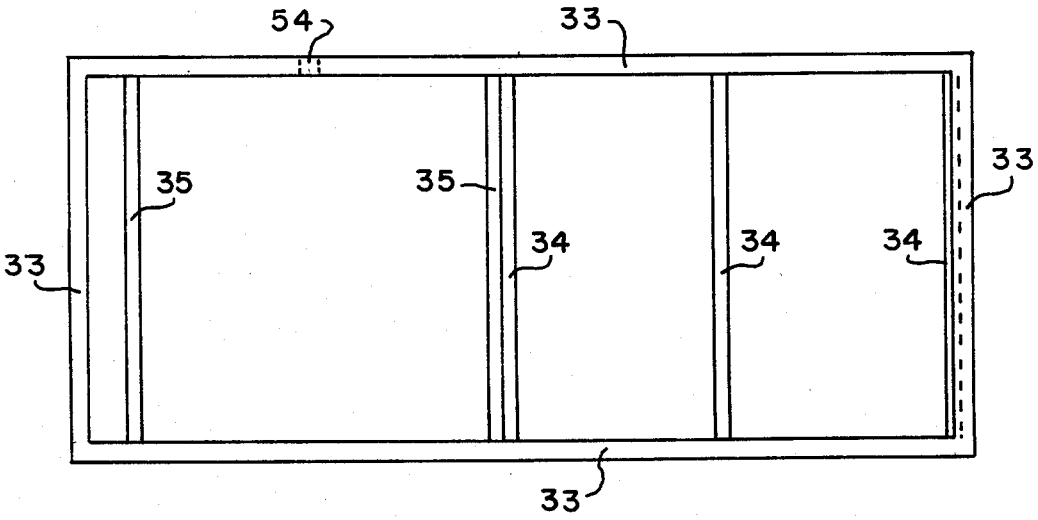
FIG. 14 is a plan view of the floor frame.

The turntable assembly 29 is incorporated in the floor 22 which has, FIG. 14, a five inch deep channel perimeter frame 33. Cross members 34 support the concrete floor of the work area 24 and cross members 35 support the carriage and turntable assemblies 29.

Figure 4:
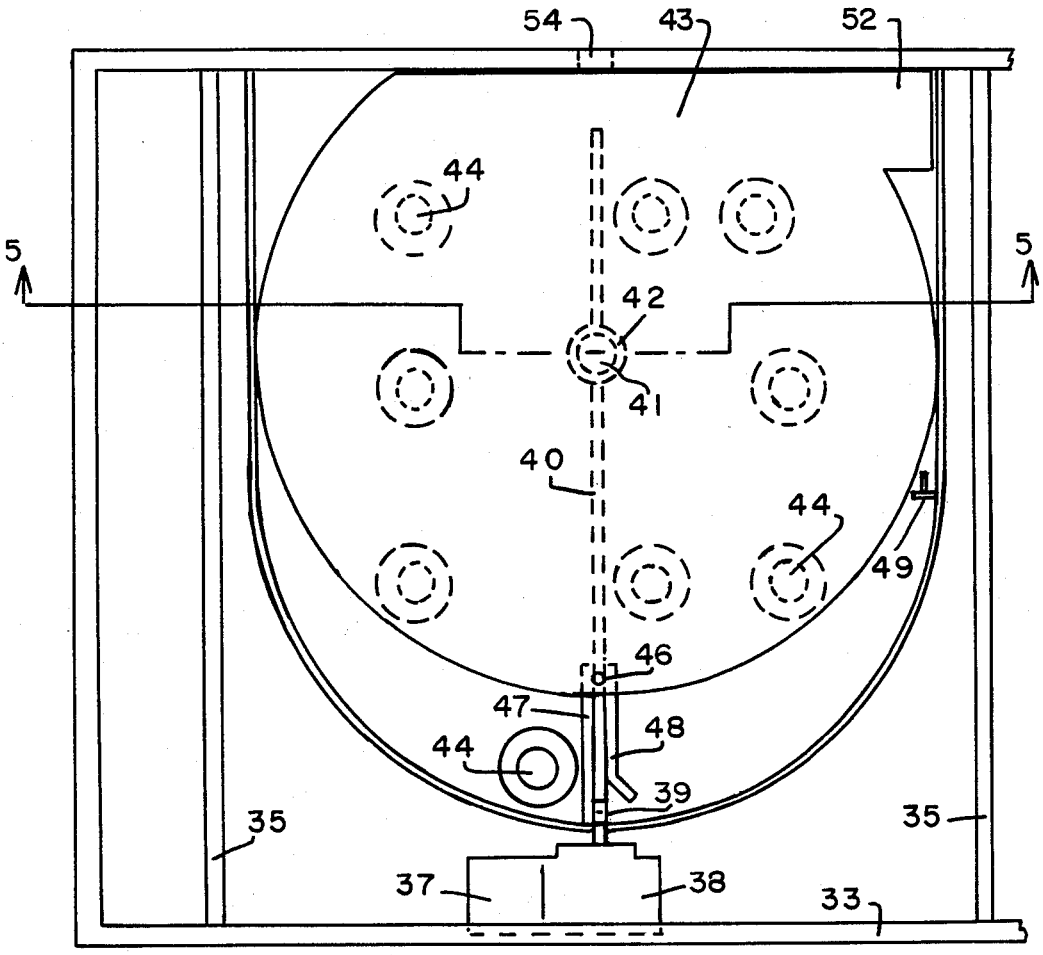
FIG. 4 is a plan view of a preferred portion of a base subassembly showing carriage and turntable elements.
Figure 5:
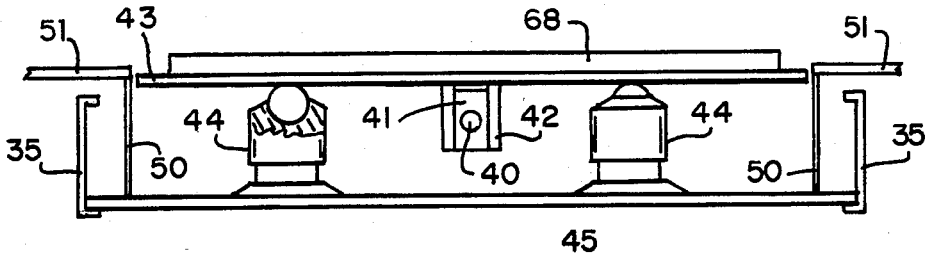
FIG. 5 is a section view through the carriage and turntable taken along lines 5—5 of FIG. 4.
Figure 8:
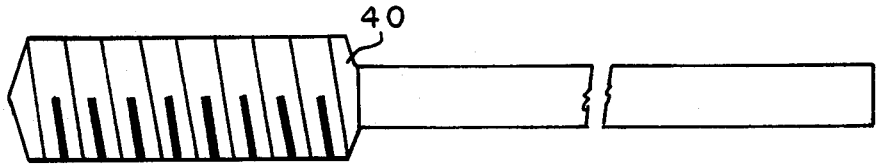
FIG. 8 is a view of a driveshaft used for lateral motion of turntable assembly, taken perpendicular to is axis of rotation.
Figure 11:
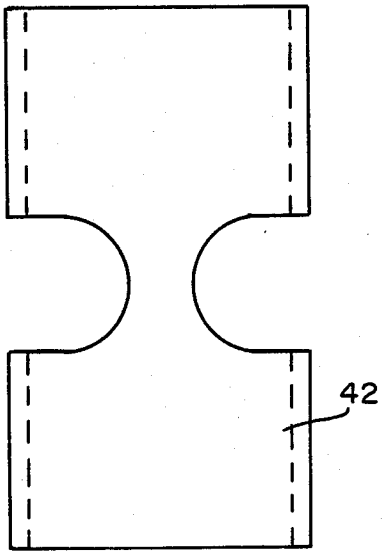
FIG. 11 depicts a nut collar for captivating the traveling nut of FIG. 9 to the preferred turntable assembly of FIGS. 4 and 5.
Figure 9:
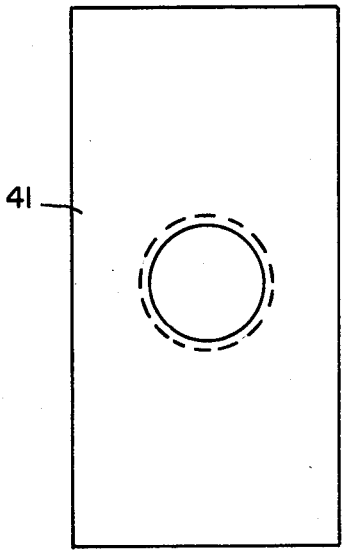
FIG. 9 is an elevation view of a traveling nut for the driveshaft.
Figure 12:
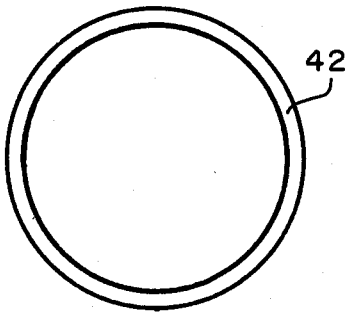
FIG. 12 is an end view of the nut collar of FIG. 11.
Figure 10:
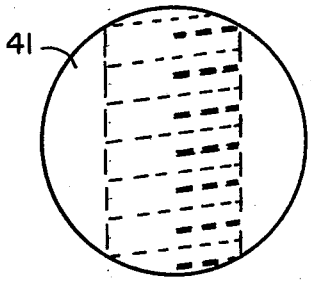
FIG. 10 is an end view of the traveling nut of FIG. 9.

A preferred embodiment of the carriage and turntable assemblies 29 is shown in FIGS. 4 and 5. Translational motion is produced by a powered drive system while rotational movement is caused by the applied manual force of the servicing personnel. The powered drive for translational motion is activated from a three position electrical switch 36, mounted in the work area 24 (See FIGS. 2 and 3). The powered drive, FIG. 4, comprises a reversiblel electrical motor 37, a speed reducer and right angle transfer mechanism 38, a universal joint 39 for connection to a threaded drive shaft 40 (See also FIG. 8) which engages and extends through a traveling nut 41 (See also FIGS. 9 and 10). The traveling nut 41 is captiated by a nut collar 42 (See also FIGS. 11 and 12) that is welded to te bottom side of the main plate 43 of the turntable assembly. Rotation of the drive shaft 40 causes the nut 41 to "chase the threads", thus providing a translational motion of the carriage. Clockwise rotation of the shaft 40 moves the turntable 29, and ATM 11, from the operational to the servicing position.

A multiplicity of transfer bearings 44, typically of the ball in socket type (as for example, the commercial Matthews type 501), are fixed to the enclosure base plate 45 in a distributed pattern, such as shown in FIG. 4, to provide support of the turntable main plate 43 in all of its possible positions. The transfer bearings 44 limit friction during translational motion of the carriage and rotational motion of the turntable plate 43.

A guide pin 46 is fixed near the edge of the turntable main plate 43 in an orthogonal plane intersecting the axis of the drive shaft 40. As the nut 41 chases the thread of the rotating shaft 40 the guide pin 46 follows between guide members 47 and 48, each attached to the base plate 45, so that the turntable 29 and ATM 11 are maintained in an accurate position during withdrawal and during return to the operational position. At the limit of the withdrawal travel of the carriage 29 the motor 37 is deactivated. At this limit the guide pin 46 will clear member 48 so as to permit manual rotation of the turntable 43 through ninety degrees in the counterclockwise sense until the pin 46 strikes the positive stop 49. A retainer member 50, in fixed position between the base plate 45 and the work area floor plate 51, constrains the entire turntable assembly 29 and the ATM thereon to precise positions.

A mechanical stop 52 is provided as an integral extension of the turntable main plate 43. As this stop 52 strikes the retainer 50 clockwise rotation of the turntable assembly is limited so that the ATM 11 is positioned to re-enter the bezel 53 and wall opening 14. As the forward translational movement of the carriage 29 progresses, gguide pin 46 and guide members 47 and 48 align the ATM 11 for positive re-entry into the bezel 53 and wall opening 14 for seating against weatherstripping, if the steel plate 31 is stowed. Spacer plate 68, FIG. 5, allows vertical adjustment of the ATM 11.

Figure 13:
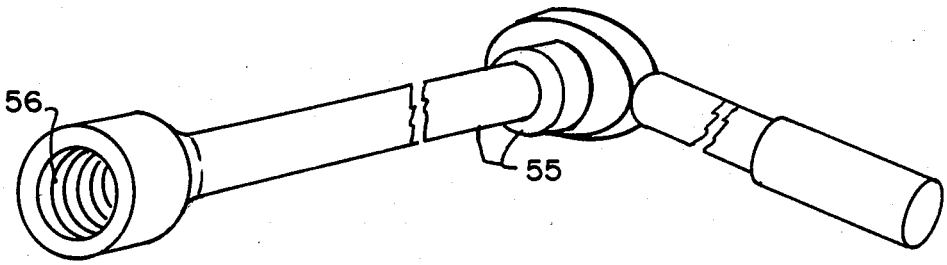
FIG. 13 is a perspective view of a special wrench for securing the ATM, by manual means.

In the event of an electrical or mechanical malfunction, during servicing, the ATM 11 must be returned to its operational position to ensure security of the terminal 10. Near the base of the front wall 15, plate 21 covers an access port 54 through which an extension bar and socket like wrench 55 (See FIG. 13) may be inserted to engage the threaded end of the drive shaft 40. By virtue of a female thread 56 of the socket wrench 55, the drive shaft may be turned manually only in the required direction of pull the ATM 11 to the forward position to engage the bezel 53 and wall opening 14.

Figure 6:
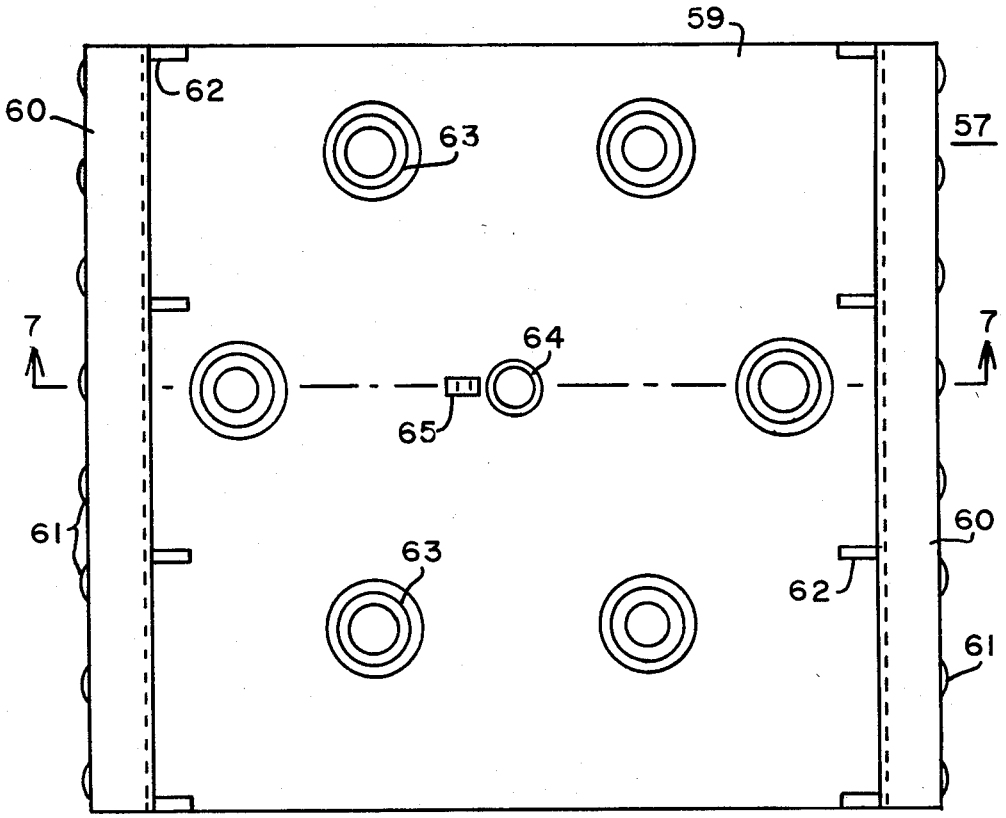
FIG. 6 illustrates an alternate support table embodiment.
Figure 7:
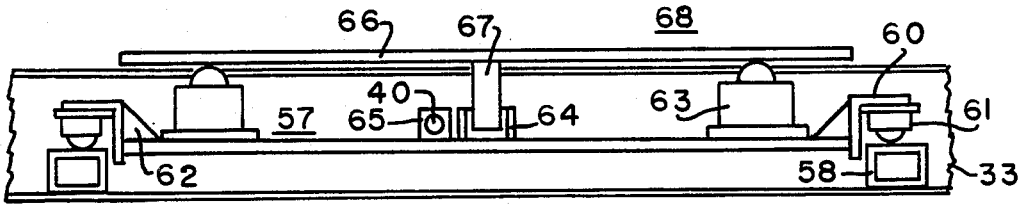
FIG. 7 is a view through a combined support and turntable assembly according to an alternate embodiment, taken along line 7—7, FIG. 6.

FIGS. 6 and 7 illustrate an alternative embodiment of apparatus for supporting and moving the ATM 11. In the alternative a support table assembly 57 of rectangular form rides on two tubular guide and framing rails 58, each of which is disposed at opposite edges of the table 57. The support table assembly 57 together with the drive apparatus, previously described, provide translational motion of the ATM 11 from its forward operational position toward the interior of the enclosure 12 for servicing. For manual rotary motion the support assembly 57 carries a superimposed turntable assembly 68, of partial circular form, upon which the ATM 11 is mounted.

The support table assembly 57 comprises a rectangular base plate 59, angle members 60 attached to and extending across two opposite edges of the plate 59, a multiplicity of ball-socket bearings 61 attached to each angle member 60 so as to distribute the load while engaging with the tubular guide and framing rails 58, triangular web elements 62 to reinforce the attachment of the base plate 59 and angle members 60, a multiplicity of ball-socket bearings 63, distributed in a circular pattern on the upper surface of the plate 59 so as to engage and support the turntable assembly 58, a circular flange 64 mounted to the upper surface (at the center of the circular pattern of bearings 63) to contain, position and guide the turntable assembly 58, and a threaded member or nut 65, oriented and attached to the upper surface of the plate 59 through which a drive shaft 40, of the power train previously described extends to produce translational motion on activation of the electrical motor 37.

The alternate turntable assembly 58 comprises a flat plate 66, having a plan view shape similar to that of the main plate 43 with stop 52 previously described in the preferred embodiment (see FIG. 4). To the bottom side of the plate 66 is fixed a center post 67. When installed superimposed on the support table assembly 57 the center pot 67 is contained within the flange 64 of the rectangular base plate 59.

Applicable to the alternative embodiment are other features providing limits of travel and manual recovery in the event of malfunction or electrical power failure as previously described for the preferred embodiment.

While the invention has been described in terms of certain specific embodiments, it is understood that various modifications and substitutions can be made in any of them within the scope of appended claims which are intended to include equivalents of such embodiments.

We claim:

1. A portable terminal for conducting remote electronic banking transactions with pedestrians and motorists, using an automated teller machine housed within a secured enclosure that is adapted for installation in narrow places comprising drive-through service islands, pedestrian walkways, malls, and retail outlets, said enclosure having an interior vault wherein a first volume of spaced occuped by said teller machine, as located for transactional operations responsive to said pedestrians and motorists, precludes access to the internal elements of said machine, and a second volume of space contiguous to said first volume, having a secured means of entry thereto, comprises working space for service personnel to service, test, and maintain said teller machine, wherein the improvement comprises:

a. turntable upon which said teller machine is mounted;

b. mechanical carriage supporting said turntable, operable by said service personnel for moving said teller machine from its operational location where transactions are performed by said pedestrians and motorists to an interior location within said secured enclosure interfacing said second volume of space comprising working space for visiting service personnel, and c. means, responsive to said service personnel, for rotation of said turntable and said teller machine mounted thereto through a sector of azimuth angles about a vertical axis so as to permit access by said service personnel for their routine servicing, testing, and maintaining of said interior elements of said teller machine.

2. A portable terminal for conducting remote electronic banking transctions with pedestrians and motorists, according to claim 1, wherein said enclosure occupies a minimum area of 4 to 8 feet, and accepts teller machines weighing in the range of 1000 to 3600 lbs. requiring cabinets as large as 28 inches wide, 36 inches deep, and 72 inches tall, with a first exterior wall at the front of said enclosure extending for a nominal length of 8 feet, said first wall having an aperture therein at said operational location through which customer-responsive elements and controls are positioned when said teller machine is located for said transactional operations; means for securely closing said aperture when said teller machine is moved from said operational location; and wherein said sector of azimuth angles for rotation of said platform and teller machine is at least 90 degrees.

3. A portable terminal for conducting remote electronic banking transactions with customers comprising pedestrians and motorists, using an automated teller machine housed within a secured enclosure having four vertical walls, a roof, and a base subassembly adapted in a rectangular plan configuration for installation in narrow places comprising drive-through service island, pedestrian walkways, malls and retail outlets, a secured vault of said enclosure having protected working space therein adjacent to said teller machine for service personnel to service, test, and maintain said teller machine, said enclosure having means for minimizing variations of the interior ambient environment, wherein the improvement comprises:

a. a mechanical carriage, assembled in said base subassembly, for moving said teller machine from its operational location at a frontal wall of said enclsoure whereat said customers make said banking transactions to an internal location within said vault of the enclosure whereat said service personnel service, test, and maintain said teller machine, the motion of said carriage being reversible and responsive to the control of said service personnel;

b. a mechanical turntable assembled upon said carriage and operable at said internal vault location for the rotation of said teller machine about a vertical axis through a sector of azimuth angles thereby permitting the cabinet of said teller machine to be opened for access to the internal elements thereof by said service personnel to enable the servicing, testing, and maintenance of said teller machine, the rotation of said turntable being reversible and responsive to forces applied by said service personnel;

c. means for constraining the translational motion of said carriage to a defined path between said operational and internal locations;

d. means for limiting azimuth rotation of said turntable and teller machine;

e. a reversible electromechanical drive system, responsive to control by said service personnel, for propelling said carriage; and f. means, operable by said service personnel, for manually securing said terminal under emergency conditions comprising loss of electrical power and equipment malfunctions to inhibit entry of said enclosure by unauthorized persons.

4. A portable terminal for conducting remote electronic banking transactions with customers comprising pedestrians and motorists, according to claim 3, wherein said base subassembly comprising said carriage and said turntable still further comprises:

a. a main plate, upon which said teller machine is mounted, of truncated circular configuration having an integral extension of said main plate along the line of truncation forming a means for mechanical registry of said teller machine relative to said frotal wall of the enclosure, and a nut collar affixed to the underside of said main plate at the center of said truncated circular configuration for the application of translational forces;

b. a multiplicity of load transfer bearings, in excess of three, fixed to the upper surface of a base plate of said enclosure, said transfer bearings distributed in a pattern so as to engage and support said main plate with said teller machine mounted thereon, for reducing friction of said carriage and turntable;

c. said reversible electromechanical drive system for producing said translational motion further comprising:

a reversible electrical motor for generating mechanical power;

a speed reducer and right angle drive mechanism for transfer of said mechanical power;

a universal joint for coupling said drive mechanism to a threaded drive shaft;

a traveling nut for engaging said drive shaft so as to chase its threads thereby applying said translational forces to said main plate, said nut being assembled and retained within said nut collar; and a three-position switch located on an inside surface of a wall enclosing said vault working space whereby said service personnel applies electrical power to operate said reversible electromechanical drive system for propelling said carriage.

5. A portable terminal for conducting remote electronic banking tranactions with customers comprising pedestrians and motorists, according to claim 3, wherein said means for constraining the translational motion of said carriage to a defined path between said operational and internal locations further comprises:

a. a U-shaped retainer, affixed in orthogonal manner between said base plate of said enclosure and a parallel floor plate in said vault, said retainer for enabling a maximum distance of translational motion;

b. a pair of cooperating guide members, forming a channel, for containing a guie pin during translational motion, said guide members having an exit for said guide pin at the maximum point of inward translational motion thereby enabling rotational motion of said turntable, said cooperating guide members affixed orthogonally to said enclosure base plate in a direction parallel to and containing the rotational axis of said drive shaft;

c. said guide pin, fixed to said main plate near its circular edge located along the diameter bisecting said line of main plate truncation, for stabilizing the azimuth angle of said carriage and turntable throughout said translational motion, and for enabling a range of 90 degrees of rotational motion; and d. a mechanical stop affixed between said enclosure base plate and said U-shaped retainer for enabling, in cooperation with said guide pin, azimuth rotation in a counterclockwise sense through 90 circular degrees, thereby locating said teller machine for maintenance servicing from the position of said vault working space.

6. A portable terminal for conducting remote electronic banking transactions with customers comprising pedestrians and motorists, according to claim 3, wherein said means, operable by said service personnel for manually securing said terminal under energency conditions comprising loss of electrical power and equipment malfunctions to inhibit entry of said enclosure by unauthorized persons, further comprises:

a. a hand tool in the nature of a cranking wrench, formed of a ratchet, extension rod, and a socket having female threads therein, for the manual application of force via said electromechanical drive system to said carriage which supports said teller machine;

b. a threaded end of a shaft of said drive system upon which said socket with female threads may be engaged for manual rotation of said shaft in the direction required to return said teller machine to said operational location;

a nut, assembled upon said shaft having threads thereon, said nut responsive to rotation of said shaft, for producing translational forces and resulting motion of said carriage;

d. a main support plate of said carriage and turntable assemblies having a nut collar affixed to its central point, said collar for containing said nut and for transfering the forces and resulting motion of said nut to said main support plate upon which said teller machine is mounted; and e. an access port in said base subassembly of said enclosure through which said hand tool is inserted to engage said threaded shaft, said access port having a removable cover plate.

7. A base subassembly of a remote electronic banking terminal, of the type having a narrow rectangular floor plan for installation upon drive-up service islands and pedestrian walkways where customers make transactions through an unattended automated teller machine, comprising:

a. a rectangular plate forming a subfloor permanently attachable to the vertical walls of said terminal;

b. a pair of guide and framing rails, arranged in parallel and affixed to said plate in orthogonal directions relative to the sides having the larger dimension;

c. a support table, reversibly movable, having means for riding upon said guide an framing rails between a first location of said teller machine for operational transactions with said customers and a second location in the interior of said terminal where servicing of said machine is performed by service personnel;

d. a reversible electromechanical drive system, for propelling said support table upon said rails, responsive to commands of said service personnel that are entered by operation of a three-position electrical switch located within the interior working space of said terminal; and e. a turntable, reversibly rotatable, when said teller machine is placed at its servicing location, responsive in rotation to manual forces applied by said service personnel, said turntable superimposed upon said support table.

8. a base subassembly of a remote electronic banking terminal, according to claim 7, still further comprising:

a. said support table, comprising:

a rectangular table plate in a plane parallel to said subfloor;

a pair of right angle members attached to and extending across opposite edges of said table plate, in a manner that locates the inside angle corners on the underside of said angle members;

a first multiplicity of ball-socket bearings, half of which are attached to the underside of each said angle member for distributing the load and reducing friction while engaging and moving on said guide and framing rails;

a multiplicity of triangular web elements for reinforcing the attachment of said rectangular table plate to each said angular member;

a second multiplicity of ball-socket bearings, distributed in a circular pattern and affixed to the upper surface of said table plate for distributing the load and reducing friction while engaging said turntable during rotation;

a circular flange, mounted to the upper surface of said table plate at the center of said circular pattern of ball-socket bearings, for containing, positioning, and guiding said turntable; and a threaded nut, attached adjacent to said circular flange to the upper surface of said table plate, for coupling to a threaded shaft of said electromechanical drive system;

b. an electromechanical drive system for providing translational motion of said support table, comprising;

a reversible electrical motor for generating mechanical power;

a speed reducer and right angle drive mechanism for transfer of said mechanical power; and a universal joint for coupling said drive mechanism to said threaded shaft for producing said translational motion through said threaded nut;

c. said turntable, comprising:

a flat turntable plate, having a truncated circular form, positioned in a plane parallel to said table plate and said subfloor engaging said second multiplicity of ball-socket bearings, for supporting said teller machine mounted thereon; and a center post, affixed to the underside of said first turntable plate, for containment within said circular flange of said support table thereby controlling said rotary motion.

* * * * *